US006006901A

United States Patent [19]

Pereira Da Silva

[11] Patent Number: 6,006,901

[45] Date of Patent: Dec. 28, 1999

[54] CONSTRUCTION DEVICE TO HOLD SOAP POWDER AND THE LIKE

[75] Inventor: Marco Antonio Pereira Da Silva, Bauru/SP, Brazil

[73] Assignee: Plasutil Industria e Comercio de Plasticos Ltda., Brazil

[21] Appl. No.: 09/175,628

[22] Filed: Oct. 20, 1998

[30] Foreign Application Priority Data

Oct. 20, 1997 [BR] Brazil ..... 7702338 U

[51] Int. Cl.[6] ..... A47K 5/08

[52] U.S. Cl. ..... 206/77.1; 206/540; 220/501; 220/669

[58] Field of Search ..... 206/77.1, 528, 206/540; 220/501, 505, 554, 555, 796, 797, 361, 669

[56] References Cited

U.S. PATENT DOCUMENTS

| | | | |
|---|---|---|---|
| 898,931 | 9/1908 | Schaal | 220/796 |
| 1,380,908 | 6/1921 | Hothersall | 220/796 |
| 3,987,829 | 10/1976 | Leone | 220/669 |
| 4,420,083 | 12/1983 | Baustin | 206/538 |
| 4,538,731 | 9/1985 | Cillario | 206/540 |
| 5,735,422 | 4/1998 | Binter | 220/4.21 |
| 5,819,944 | 10/1998 | Terrasi | 206/534 |
| 5,833,115 | 11/1998 | Eiten | 220/669 |

*Primary Examiner*—Paul T. Sewell
*Assistant Examiner*—Nhan T. Lam
*Attorney, Agent, or Firm*—Ostrolenk, Faber, Gerb & Soffen, LLP

[57] ABSTRACT

A device to hold soap flakes and the like includes a container body having a dispensing meter built into the container. The container has front, rear, and side walls that form an opening at the top. Vertical walls within the container define baffles that allow powder to flow into a dosing compartment for dispensing from the container. A removable cover seals the top of the container and has an opening through which soap powder is dispensed.

7 Claims, 2 Drawing Sheets

CONSTRUCTION DEVICE TO HOLD SOAP POWDER AND THE LIKE

BACKGROUND OF THE INVENTION

1. Field of the Invention

The present invention relates to the utility model of a device to hold soap powder, and the like, and, more specifically, a device to hold soap powder, with a dose meter.

2. Description of the Related Art

Currently soap powder, and the like, such as soapies and powder detergents are sold in paperboard packages.

Even though such packages are satisfactory for their use, they bear a few inconveniences.

One of such inconveniences refers to the fact that the material used to make such packages, as already mentioned, generally paperboard, is not resistant to humidity, i.e., is not waterproof, therefore does not grant adequate protection to the powder contained therein, as such products are kept close to humid sites, such as beside the washing vat or washing machine.

Another inconvenience found on such conventional packages of powder soap lies in that they do not have a selective opening and closing cover, i.e., after the package is opened by breaking the perforated line, it is not possible to close it again, thus the contents become exposed to the effects of humidity which inevitably reached the internal portion of the package, causing the powder to form lumps.

Another inconvenience verified in such conventional packages refers to the fact that they do not bear a powder measurer or dosing device, causing waste of product when it is used for washing.

SUMMARY OF THE INVENTION

Therefore, the present innovation provides a device to hold soap powder and the like, built of waterproof material showing resistance to humidity, granting adequate protection to the powder contained therein, even if such package is kept close to humid sites, such as close to the washing vat or washing machine.

The present innovation also provides device to hold soap powder and the like, which enables the reutilization of the soap container with powder recharge, which is maintained protected against humidity through the closed cover of the powder hold and of the overcover with a selective opening and closing system.

The present innovation also provides a device to hold soap powder and the like, containing an internal dose meter, eliminating product waste.

Those and other objects and advantages of the present innovation are reached with a construction device to hold soap powder and the like, comprising a prismatic body of substantially an irregular parallelepipedal form, showing an oblong rear wall with an arched front edge, cuts and re-entrances in its lateral-longitudinal edges, close to its straight rear edge.

From the rear wall there are projected upward, with a slightly diverging inclination, the corresponding lateral walls, back and front, culminating in free superior edges which form the access opening of the prismatic body. The lateral walls, respectively, show a vertical rectangular re-entrance in their frontal portion which is extended from the inferior edge to close to the top free edge of such lateral walls and also a prismatic re-entrance extended through almost the totality of its height and presenting vertical and horizontal grooved edges, forming with the thin back wall a bottleneck region of the prismatic body. The back wall presents a small inferior width, which increases gradually from bottom to top, ending close to its free top edge, where, in a sudden widening, it reaches the total width of its free top edge The front wall of such prismatic body is defined by a flat and arched surface, accompanying the semi-circular border of the front edge of the backside wall, and extending upwards from such latter diverging form, adjusting to the front arched portion of the free top edge which has a semi-circular contour with a higher diameter than that defined for the backside wall.

Internally, such prismatic body incorporates in its inferior wall a brim or vertical screen of small height, placed intermediately to the width of the re-entrance defined by the lateral walls. In front of the front edge of the vertical screen there is inserted a vertical wall which reaches from top to bottom almost the totality of the height of the prismatic body, defining an opening or passage beside the backside wall and in front of the low height screen. The vertical wall forms a baffler or dosing deviation for the prismatic body, which has its free top edge closed by a substantially rectangular contour cover with a rounded front transversal edge. Such cover with a contour edge of small width and turned downwards is superposed to the free superior edge of the prismatic body, closing the latter. The front portion of such cover bears a rectangular hole which is selectively opened and closed by a laminar overcover which slides in relation to the cover.

We describe below the innovation with reference to the enclosed drawings, where:

FIG. 2 represents a backside view of the preferred holder of powder soap and the like;

DETAILED DESCRIPTION OF THE PREFERRED EMBODIMENTS

Figure 2:
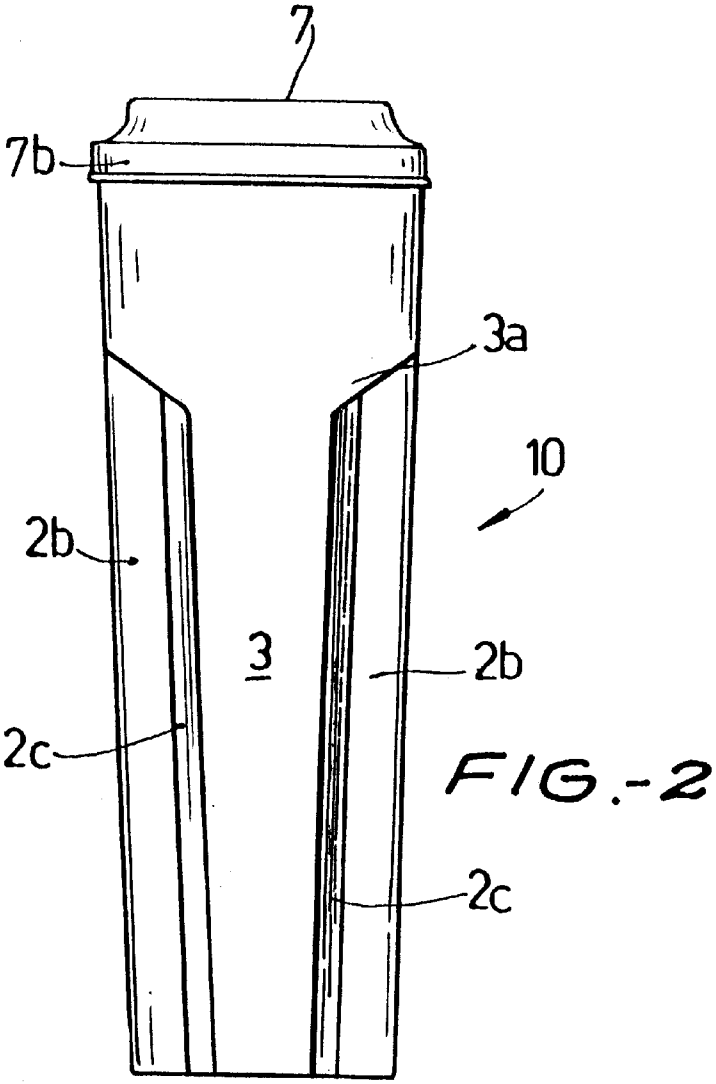
Figure 1:
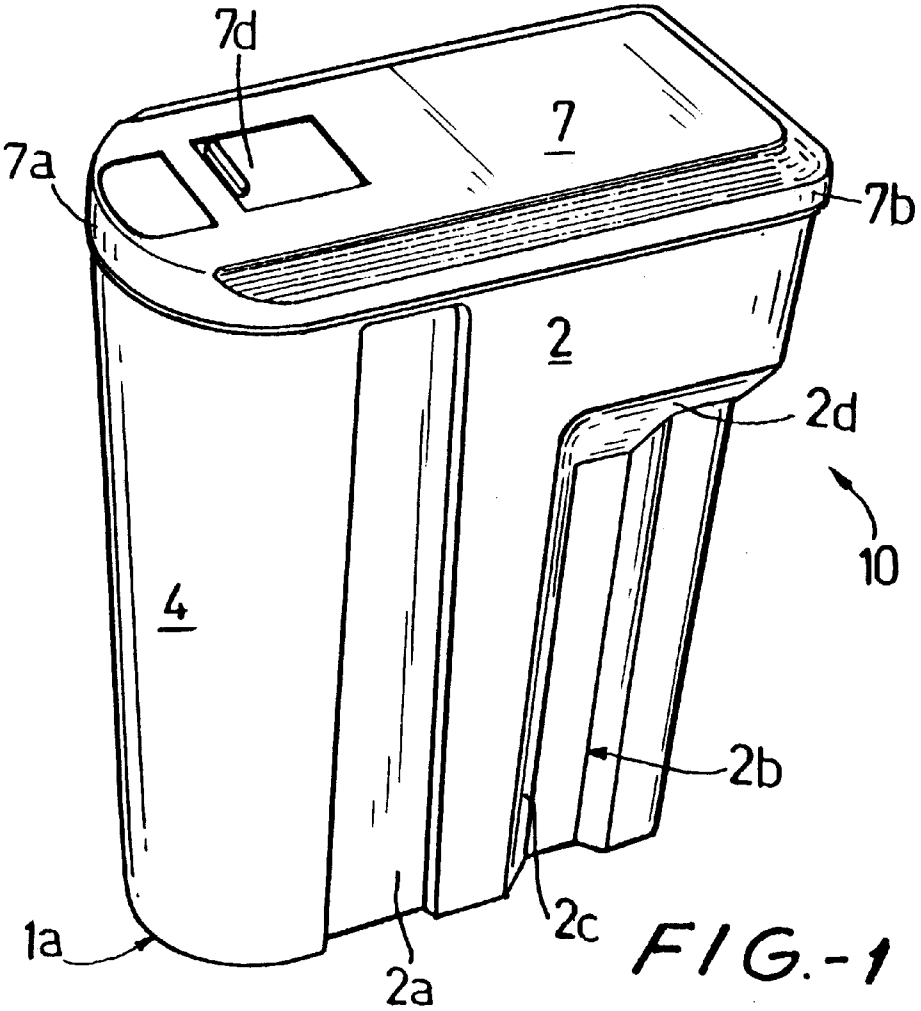
FIG. 1 represents a perspective view of the holder of powder soap and the like, according to the present invention.

As shown in FIGS. 1–4, the holder for powder soap and the like, of the present innovation, includes a prismatic body 10 of substantially irregular parallelepipedal format, showing an oblong bottom wall 1 with an arched front edge, 1*a*, cuts and re-entrances in its lateral-longitudinal edges, 1*b*, close to its straight rear edge 1*c*. From such bottom wall 1 there are projected upward, with a slightly diverging inclination, the corresponding lateral walls 2, back 3 and front 4, culminating in free superior edges 5 which form the access opening of prismatic body 10. The lateral walls 2, show a vertical rectangular re-entrance 2*a* in the frontal portion which is extended from the inferior edge of the bottom wall 1, up to close to the top free edge 5 of such body 10 and also incorporate a prismatic re-entrance 2*b* extended through almost the totality of their height and presenting vertical 2*c* and horizontal grooved edges 2*d*, forming with the thin back wall 3 a bottleneck region of the prismatic body 10.

The backside wall 3 presents a small inferior width, which increases gradually from bottom to top, ending close to the free top edge 5 of body 10, where, in a sudden widening 3*a*, it reaches the total width of its free top edge 5 of body 10.

The front wall 4 of such prismatic body 10 is defined by a flat and arched surface, accompanying the semi-circular border 1*a* of the bottom wall 1, and extends upwards starting from the latter on a divergent manner, adjusting to the front arched portion of the free top edge 5 of the body 10, which has a semi-circular contour with a greater diameter than that defined for the front edge 1*a* of the bottom wall 1.

Figure 3:
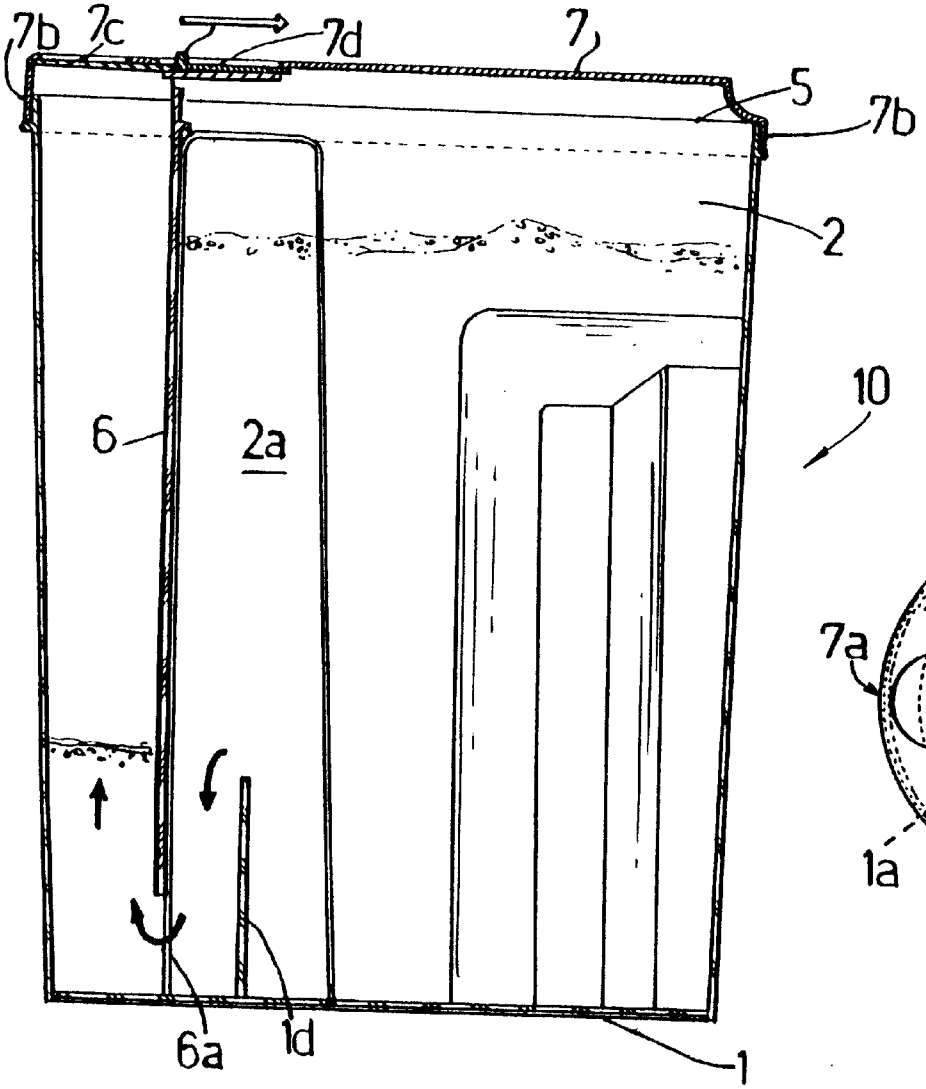
FIG. 3 represents a vertical cross section of the holder of powder soap and the like; illustrating through arrows the course of the dosed powder to be withdrawn from the body of the soap holder.
Figure 4:
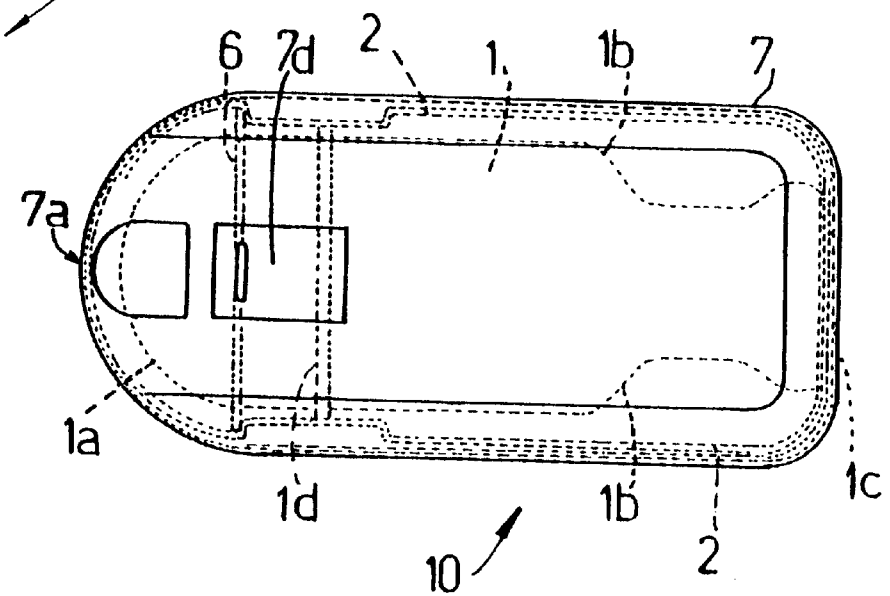
FIG. 4 represents a top view of the holder of powder soap and the like, ilustrated in the previous pictures.

As can be seen from FIG. 3, internally, such prismatic body 10 incorporates on its bottom wall 1 a brim or vertical screen 1*d* of small height, placed intermediately to the width of the re-entrance 2*a* defined by the lateral walls 2. In front of the front edge of such re-entrances 2*a* there is inserted a vertical wall 6 of trapezoid contour which reaches from top to bottom almost the totality of the height of the prismatic body 10, defining a bottom opening or passage 6*a* beside the backside wall 1 and in front of the low height screen 1*d*, forming a baffler or dosing deviation for the prismatic body 10, determining the powder flow (see arrows) when the soap hold 10 is spilled to release the powder through its dosing opening, to be described later.

The prismatic body 10 has its free top edge 5 closed by a cover 7 of substantially rectangular contour with a rounded transversal front edge 7*a*. Cover 7 has a contour edge 7*b* with small width and is turned down, which, being inserted in the top free edge 5 of the prismatic body 10, closes the latter. On the front portion of cover 7 there is a rectangular hole 7*c*, selectively opened and closed by a laminar overcover 7*d* which slides in relation to cover 7, see FIG. 1.

With this construction concept installed in the powder soap hold 10, one obtains higher protection and economy of the product stored therein, and such powder soap hold may be manufactured in different sizes.

I claim:

1. Device to hold powders, comprising:

a container having a bottom, corresponding lateral walls, a back wall, and a front wall, culminating in free superior edges which form an access opening at a top of the container;

a vertical screen of small height, placed on the bottom of the container between the lateral walls;

a vertical wall that reaches from the top toward the bottom almost the totality of the height of the prismatic body and defining a bottom opening adjacent the bottom of the container and in front of the vertical screen, the vertical screen and the vertical wall forming a dosing deviation inside the container, the dosing deviation metering powder flow when the container is tilted to dispense powder;

a cover disposed over the access opening of the container; and an opening in the cover selectively opened and closed for dispensing powder from the container, the powder having been metered by the dosing deviation.

2. The device of claim 1, wherein the container has a substantially irregular parallelopipedal form, the lateral walls projecting upward from the bottom with a slightly diverging inclination.

3. The device of claim 1, wherein the lateral walls each comprise a vertical rectangular re-entrance disposed toward the front of the container and extending from the bottom substantially to the top of the container.

4. The device of claim 1, wherein the lateral walls each further comprise a prismatic re-entrance adjacent the back wall of the container.

5. The device of claim 4, wherein the back wall has a small inferior width adjacent the prismatic re-entrance of the lateral walls, and back wall widening toward the top of the container.

6. The device of claim 1, wherein the front wall is provided in the form of an arched surface and adjoins a curved front edge of the bottom wall of the container.

7. The device of claim 1, further comprising a laminar overcover disposed on the cover, the opening in the cover being selectively opened and closed by the laminar overcover that slides in relation to the cover.

* * * * *